US007913984B2

(12) United States Patent
Noguchi et al.

(10) Patent No.: US 7,913,984 B2
(45) Date of Patent: Mar. 29, 2011

(54) METHOD AND SYSTEM FOR GENERATING MICROBUBBLE-CONTAINED LIQUID AND MICROBUBBLE GENERATOR TO BE ASSEMBLED IN THE SYSTEM

(75) Inventors: Yukihiro Noguchi, Kanagawa (JP); Shuowei Chuang, Taipei (TW)

(73) Assignee: Sanyo Facilities Industry Co., Ltd., Kanagawa (JP)

( * ) Notice: Subject to any disclaimer, the term of this patent is extended or adjusted under 35 U.S.C. 154(b) by 1155 days.

(21) Appl. No.: 11/564,573

(22) Filed: Nov. 29, 2006

(65) Prior Publication Data

US 2007/0095937 A1 May 3, 2007

Related U.S. Application Data

(63) Continuation of application No. PCT/JP2005/010208, filed on May 27, 2005.

(30) Foreign Application Priority Data

May 31, 2004 (JP) ..... 2004-161184

(51) Int. Cl.
*B01F 3/04* (2006.01)

(52) U.S. Cl. ..... 261/29; 261/36.1; 261/76

(58) Field of Classification Search ..... 261/28, 261/29, 30, 36.1, 76, 115, 119.1, DIG. 75
See application file for complete search history.

(56) References Cited

U.S. PATENT DOCUMENTS

| | | | | |
|---|---|---|---|---|
| 4,744,956 | A * | 5/1988 | Yant et al. | 422/106 |
| 5,938,982 | A | 8/1999 | Sugiura | |
| 5,961,895 | A * | 10/1999 | Sanford | 261/36.1 |
| 5,968,352 | A * | 10/1999 | Ditzler | 210/220 |
| 6,054,046 | A * | 4/2000 | Nelson | 210/194 |
| 6,142,456 | A * | 11/2000 | Machiya et al. | 261/76 |
| 6,264,174 | B1 * | 7/2001 | Chang et al. | 261/29 |
| 6,293,529 | B1 | 9/2001 | Chang et al. | |
| 6,955,341 | B2 * | 10/2005 | Liou | 261/64.1 |
| 7,059,591 | B2 * | 6/2006 | Bortkevitch et al. | 261/76 |
| 7,159,854 | B2 * | 1/2007 | Lee et al. | 261/28 |
| 7,338,551 | B2 * | 3/2008 | Kozyuk | 95/175 |
| 2003/0071372 | A1 * | 4/2003 | Scherzinger et al. | 261/76 |
| 2004/0197195 | A1 * | 10/2004 | Ogolla et al. | 417/89 |
| 2007/0257381 | A1 * | 11/2007 | Chuang | 261/76 |

FOREIGN PATENT DOCUMENTS

| | | |
|---|---|---|
| EP | 0 831 063 A2 | 3/1998 |
| JP | 07-328402 | 12/1995 |
| JP | 10-094723 | 4/1998 |
| JP | 2000-325767 | 11/2000 |

* cited by examiner

*Primary Examiner* — Scott Bushey

(74) *Attorney, Agent, or Firm* — Kilyk & Bowersox, P.L.L.C.

(57) ABSTRACT

A microbubble generator (20) includes an outer cylinder (201), bulkhead (202) and an inner cylinder (203) extending in the downstream direction from the bulkhead (202). A plurality of liquid passage holes (202*a*) is formed in the central portion of the bulkhead (202), and a circumferential flange (203*a*) is formed at the downstream end of the inner cylinder (203). A disk (204) is disposed adjacent to the rear edge of the inner cylinder (203). The disk (204) and circumferential flange (203*a*) define a restriction passage (17) in conjunction with each other. The circumferential flange (203*a*) forming one of the wall surfaces of the restriction passage (17) has a recess (206) formed therein.

7 Claims, 9 Drawing Sheets

METHOD AND SYSTEM FOR GENERATING MICROBUBBLE-CONTAINED LIQUID AND MICROBUBBLE GENERATOR TO BE ASSEMBLED IN THE SYSTEM

The present application is a continuation of International Patent Application No. PCT/JP2005/010208, filed May 27, 2005, which in turn claims priority from Japanese Patent Application No. JP2004-161184, filed May 31, 2004.

BACKGROUND OF THE INVENTION

1. Field of the Invention

The present invention relates to a system and a method for generating a microbubble-contained liquid, and a microbubble generator to be assembled in the system.

2. Background Art

Recently, a gas-supersaturated liquid containing microbubbles has been attracting attention as being a liquid usable widely in the fields of precision-machine cleaning, agriculture, oil separation, water purification, hot spring, etc. Existing systems for generating a microbubble-contained liquid use filters. Such filter-type microbubble-contained liquid generating systems are liable to fall in filter clogging, and they cannot keep their initial performance for a long term.

U.S. Pat. No. 6,293,529 discloses an apparatus for generating microbubbles. This apparatus includes a cylinder having a bulkhead with liquid holes at the upstream end thereof and a disk disposed opposite to the bulkhead, such that the bulkhead and the disk define a restriction passage. Thereby, a gas-dissolved liquid (a liquid containing dissolved gas) is forced to pass through the restriction passage to generate a large quantity of microbubbles in the liquid.

It is known that microbubbles had better be smaller and smaller in diameter to (1) absorb suspended solids (solids suspended in water) more effectively, (2) increase the contact area between water and air and elongate the duration of time where the bubbles drift densely in water to contribute to more efficient decomposition of organic matter, and (3) penetrate more deeply into objects to be cleaned and thereby enhance the cleaning effect.

In the apparatus disclosed in U.S. Pat. No. 6,293,529, however, the microbubbles contained in the gas-supersaturated liquid are relatively large in diameter. So, the microbubble-contained liquid generated by the apparatus is applicable only to a limited field of industry.

SUMMARY OF THE INVENTION

It is therefore desirable to overcome the above-mentioned drawbacks of the existing techniques by providing a system and a method for generating a microbubble-contained liquid, capable of generating a liquid containing bubbles smaller in diameter than ever, as well as a microbubble generator to be assembled in the system.

It is also desirable to provide a system and a method for generating a microbubble-contained liquid, capable of generating a liquid in which microbubbles remain stably for a long time, as well as a microbubble generator to be assembled in the system.

It is also desirable to provide a system and a method for generating a microbubble-contained liquid, capable of generating a liquid that contains microbubbles less variable in diameter from one another, as well as a microbubble generator to be assembled in the system.

According to an aspect of the present invention, one or more of those objects of the invention are accomplished by providing a method of generating a microbubble-contained liquid that is a liquid containing microbubbles, comprising: preparing a restriction passage having a recess formed in a wall surface thereof; and forwarding a gas-dissolved liquid under pressure with a pump and making the gas-dissolved liquid pass through the restriction passage to generate a large quantity of microbubbles in the liquid.

In the first aspect of the invention, the gas-dissolved liquid is made to pass through the restriction passage to generate microbubbles by cavitation. When the gas-dissolved liquid passes through the restriction passage, a whirling flow occurs in the recess formed in the wall surface of the restriction passage. In this process, very small bubbles are produced. The whirling occurring at the recess contributes to reducing diameters of the bubbles and/or uniforming diameters of the bubbles. Microbubbles reduced in diameter can continue to exist in the microbubble-contained liquid for a long period of time. Also, since no filter is used for generation of microbubbles, the microbubble-contained liquid generating system can be easily maintained in a proper condition.

According to the second aspect of the invention, there is provided a method of generating a microbubble-contained liquid that is a gas containing microbubbles, comprising: a step of mixing a gas into a liquid supplied from a liquid source to prepare a gas-dissolved liquid; a step of drawing and forwarding the gas-dissolved liquid under pressure with a pump; and a step of making the gas-dissolved liquid forwarded under pressure by the pump to pass through a restriction passage having a recess formed in a wall surface thereof, and thereby generating a large quantity of microbubbles.

In the second aspect of the invention, a liquid containing a large quantity of microbubbles can be generated by making the gas-dissolved liquid forwarded under pressure from the pump to pass through the restriction passage having the recess formed in the wall surface thereof. To further reduce the sizes of the microbubbles, the microbubble-contained liquid exiting from the restriction passage is preferably driven to hit against a stationary surface.

According to a preferred embodiment of the invention, there is provided a microbubble generator, comprising: a main pipe through which a gas-dissolved liquid supplied under pressure flows; an intermediate wall partitioning the main pipe and having openings formed in a central portion thereof; a small-diameter pipe continuous from a downstream wall surface of the intermediate wall to face to the openings; a flange provided at the downstream end of the small-diameter pipe to extend radially outward; and a disk disposed to close the downstream end of the small-diameter pipe, wherein the disk and flange in combination define a restriction passage, and a recess is formed in one or both of opposed surfaces of the disk and the flange.

By changing the distance between the flange and the disk which define the restriction passage together, it is possible to control the diameters of the microbubbles generated by the microbubble generator. As the disk is brought nearer to the flange, the bubbles tend to decrease in size. On the contrary, as the disk is moved more distant from the flange, the bubbles tend to increase in size.

The foregoing and other features, aspects and advantages of the present invention will be come apparent from the following detailed description of the embodiments of the present invention when taken in conjunction with the accompanying drawings.

DETAILED DESCRIPTION OF THE INVENTION

Figure 1:
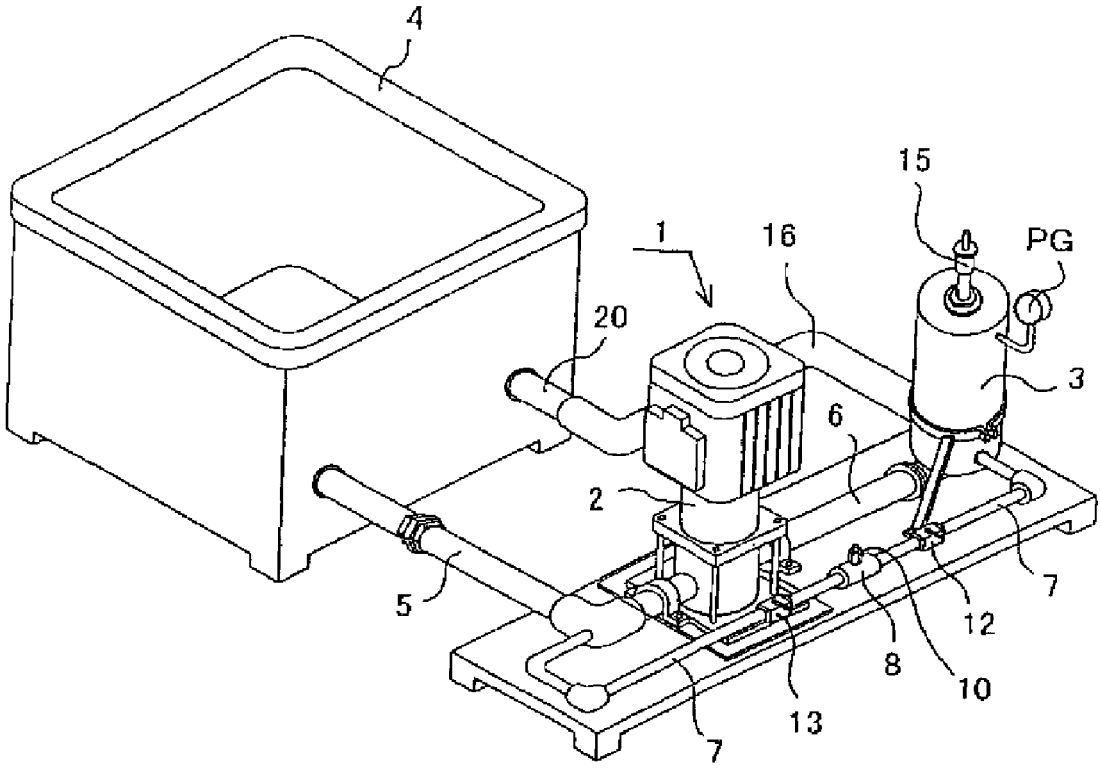
FIG. 1 is a perspective view schematically illustrating the microbubble-contained liquid generating system according to an embodiment of the present invention.
Figure 2:
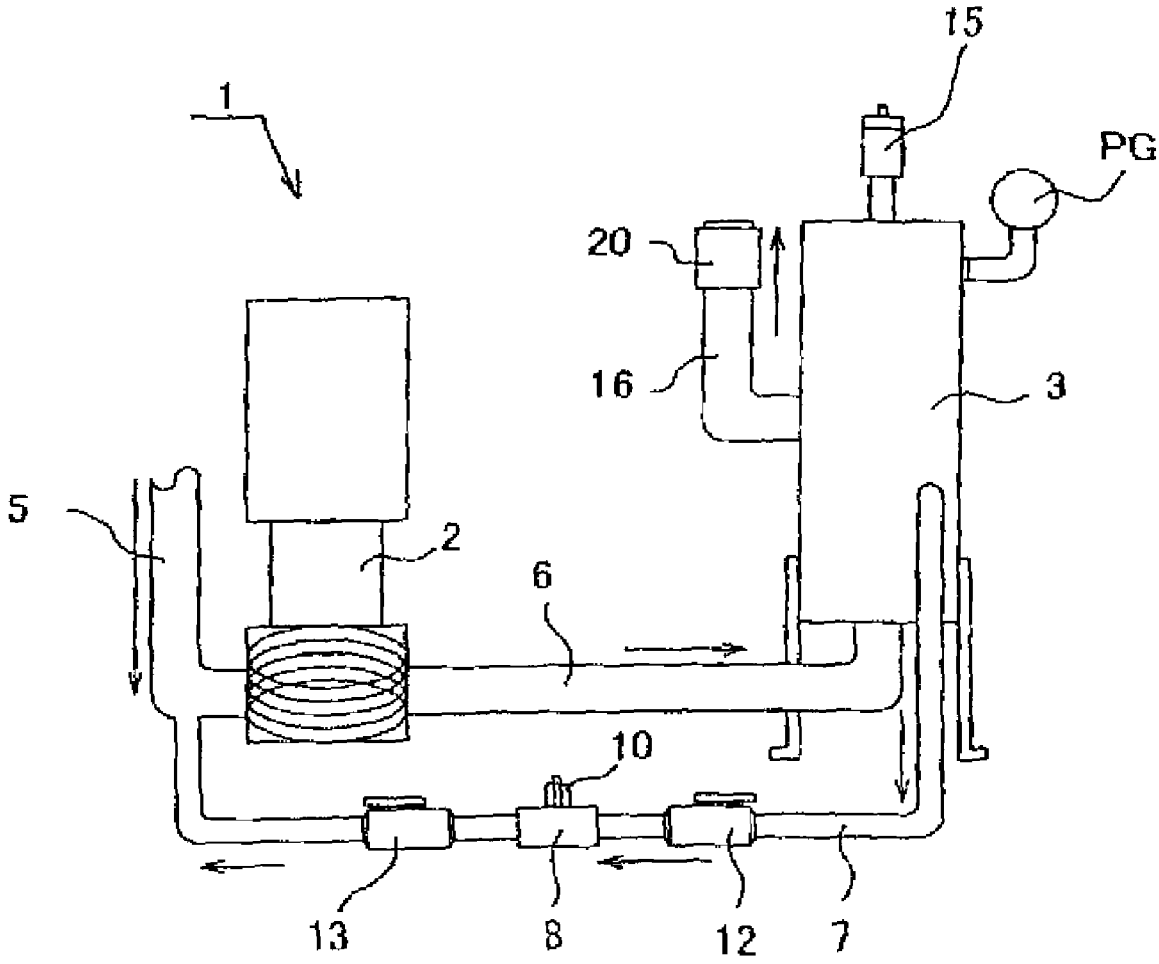
FIG. 2 is a diagram used to explain the connection between the components of the embodiment of the microbubble-contained liquid generating system shown in FIG. 1.

FIG. 1 is a perspective view a microbubble-contained liquid generating system according to an embodiment of the invention. FIG. 2 is a diagram that roughly shows the circuit of the microbubble-contained liquid generating system shown in FIG. 1. The microbubble-contained liquid generating system 1 shown here includes a circulation pump 2 and a pressure tank 3. The reference PG in FIG. 2 indicates a pressure gauge connected to the pressure tank 3. The circulation pump 2 is supplied through an inlet thereof with water from, for example, a water bath 4 via a raw water pipe 5.

The circulation pump 2 is connected at an outlet thereof to the bottom of the pressure tank 3 via a forced feeding pipe 6. Ann upstream end of a circulation pipe 7 is connected to the lower portion of the pressure tank 3. A down stream end of the circulation pipe 7 is connected to a middle portion of the raw water pipe 5. The circulation pipe 7 has a venturi tube 8 (FIG. 3).

Figure 3:
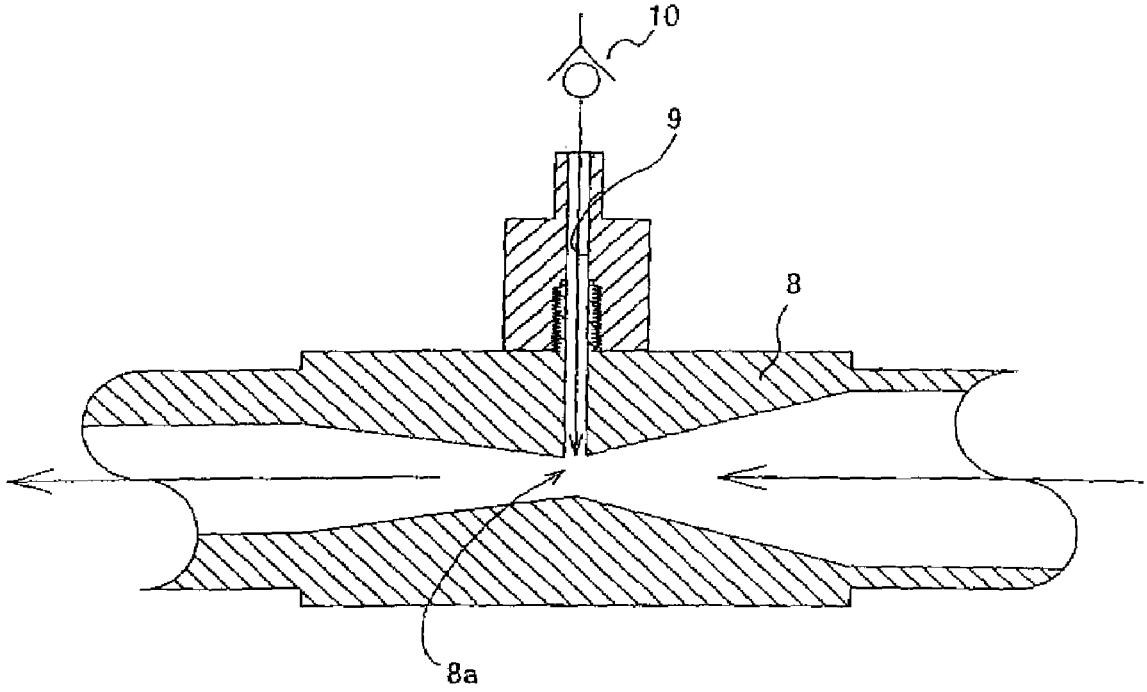
FIG. 3 is a schematic sectional view of a venturi tube for introducing air.

Referring to FIG. 3, the venturi tube 8 has a restricted portion 8*a* at which a suction port 9 opens. Through the suction port 9, ambient air is drawn into the venturi tube 8. Reference numeral 10 indicates a check valve. The suction port 9, or an air introduction tube (not shown) communicating with the suction port, is preferably equipped with a manual regulation valve (not shown) capable of regulating the amount of air that passes through it.

The circulation pipe 7 preferably has a first flow control valve 12 located upstream of the venturi tube 8 and a second flow control valve 13 located downstream of the venturi tube 8. Thus, the first flow control valve 12 can substantially control the pressure in the pressure tank 3, and the second flow control valve 13 can substantially control the air intake through the suction port 9. Preferably, the first and second flow control valves 12 and 13 are of a manually controllable type such that an operator of the microbubble-contained liquid generating system can manually adjust the pressure in the pressure tank 3 by monitoring the pressure gage PG.

On the top of the pressure tank 3, a relief valve 15 is provided to discharge excessive air from the pressure tank 3. Through the relief valve 15, internal air is discharged from the pressure tank 3 to keep it approximately full of water. Also, an upstream end of a discharge pipe 16 is connected to the pressure tank 3 preferably at a level higher than the circulation pipe 7. The discharge pipe 16 has a microbubble generator 20 at an upstream portion thereof. A microbubble-contained liquid generated in the microbubble generator 20 is discharged into the water bath 4.

Figure 4:
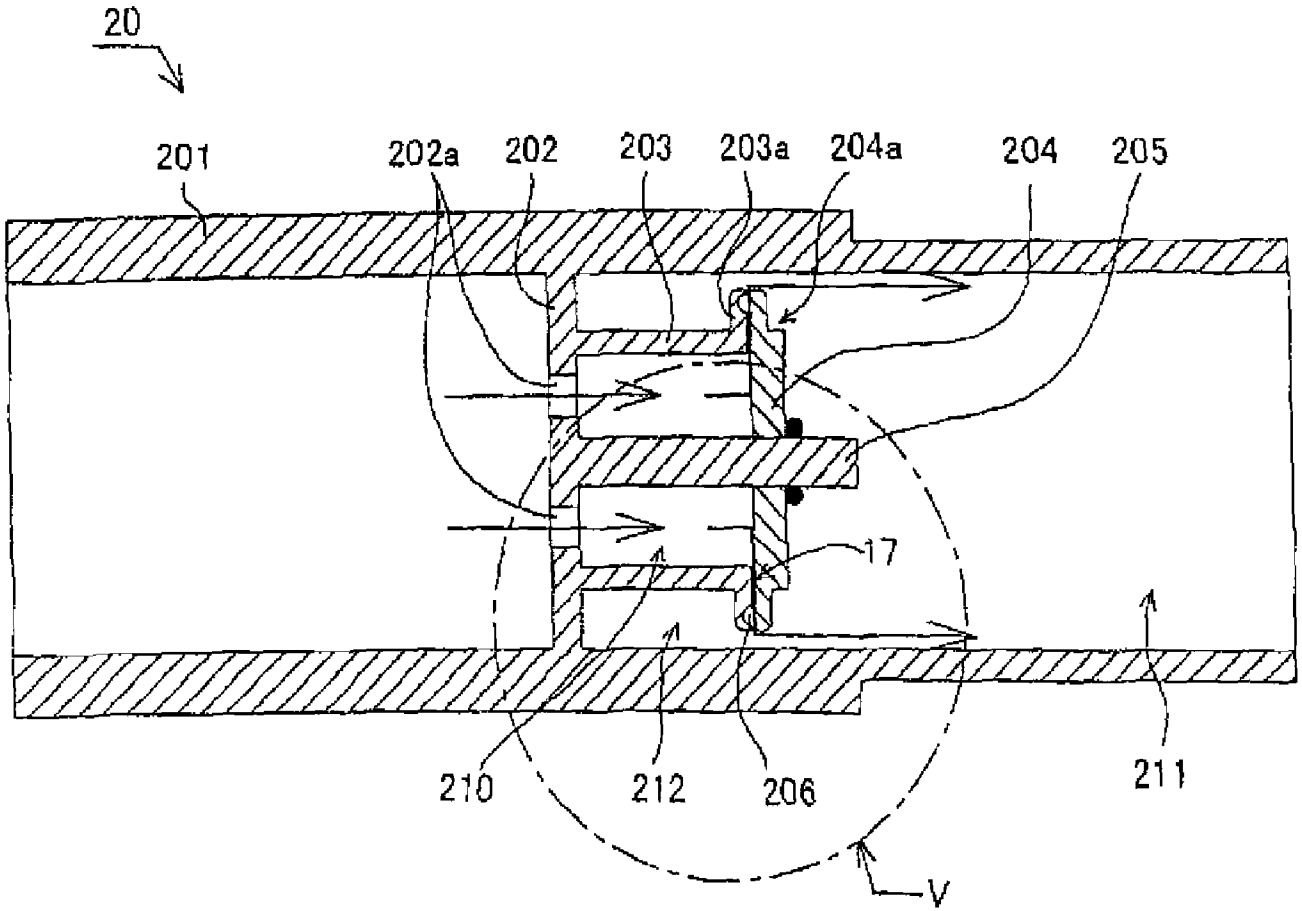
FIG. 4 is a cross-sectional view of a microbubble generator assembled in the microbubble-contained liquid generating system shown in FIG. 4.

Referring to FIG. 4, the microbubble generator 20 includes: a main pipe serving as an outer shell or cylinder 201 having a diameter approximately equal to that of the aforementioned discharge pipe 16; bulkhead 202 in form of an intermediate wall extending across the outer cylinder 201 at a lengthwise middle position of the outer cylinder 201; and an inner shell or cylinder 203 extending from the bulkhead 202 in the downstream direction and smaller in diameter than the outer cylinder 201 to form a small-diameter pipe. A plurality of liquid passage holes 202*a* is formed in the central portion of the bulkhead 202. The liquid passage holes 202*a* are preferably positioned in equal intervals along a common circle. The microbubble generator 20 is formed by molding a metal or plastic to which however the present invention is not limited.

The inner cylinder 203 is coaxial with the outer cylinder 201. The inner cylinder 203 has a ring-shaped circumferential flange 203*a* formed to extend radially from the downstream end thereof. More specifically, the circumferential flange 203*a* extends in a direction perpendicular to the downstream end of the inner cylinder 203, and the circumferential perimeter of the circumferential flange 203*a* is adjacent to the inner wall of the outer cylinder 201.

The microbubble generator 20 includes a disk 204 located adjacent to the rear perimeter of the inner cylinder 203 and extending across the outer cylinder 201. The disk 204 defines a restriction passage 17 in combination with the circumferential flange 203*a*. The disk 204 preferably has a step 204*a* formed by removing an amount of the downstream surface portion from a circumferential perimeter portion of the disk 204. The disk 204 is mounted on a support pin 205 extending downstream from a central portion of the bulkhead 202 along its axial line. In this embodiment, the disk 204 is fixed by welding after adjustment of the distance between the disk 204 and the circumferential flange 203*a*. However, the disk 204 may be movable relative to the support pin 205 to allow adjustment of the distance between the circumferential flange 203*a* and the disk 204 can be adjusted.

Figure 5:
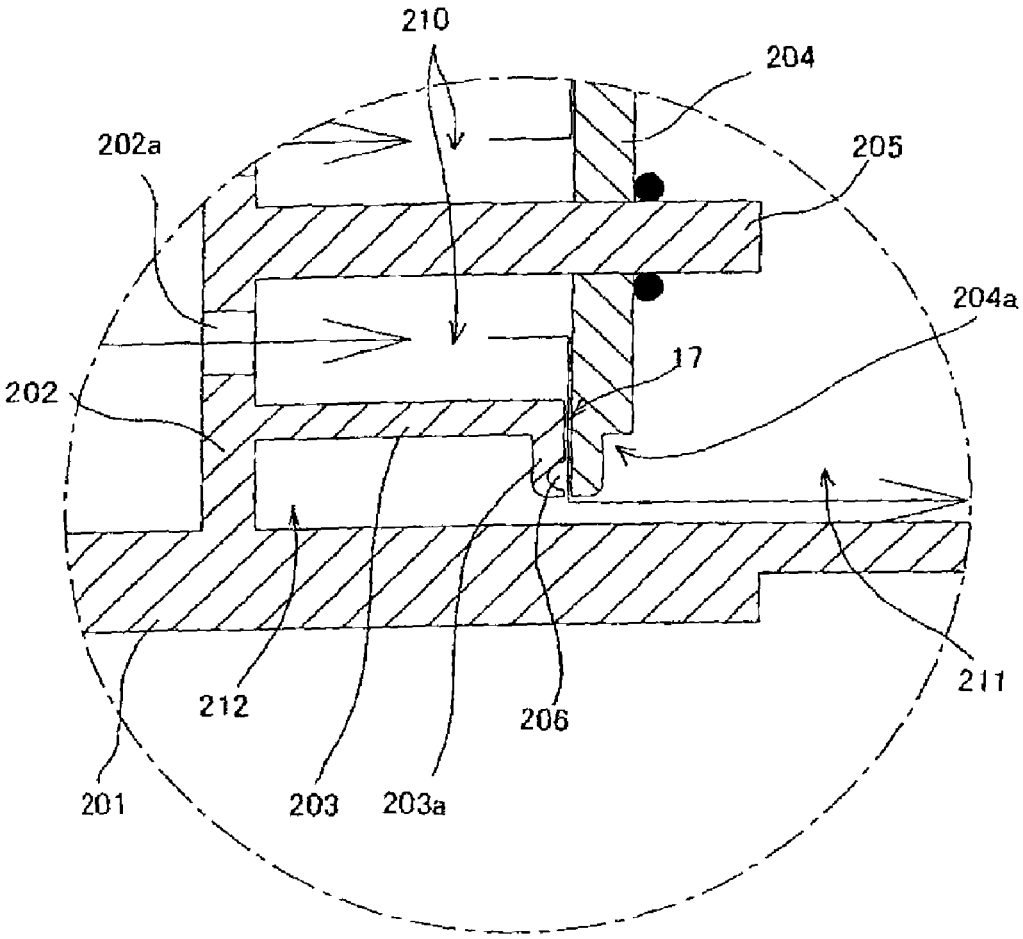
FIG. 5 is an enlarged partial cross-sectional view of the portion shown with an arrow V in FIG. 4.

A recess 206 is formed between the circumferential flange 203*a* forming the wall surface of the restriction passage 17 and a portion of the disk 204 opposed to the circumferential flange 203*a* to indent into at least one of these opposed surfaces. In this embodiment, the recess 206 is formed to indent into the circumferential flange 203*a* as shown in FIG. 5 as well. The recess 206 is preferably positioned close to the circumferential perimeter of the circumferential flange 203*a*, and has a ring-like continuous configuration. Alternatively, the recess 206 formed in the wall surface of the restriction passage 17 may be discontinuous, or a plurality of such recesses may be formed along the restriction passage 17.

Water in the water bath 4 is introduced into the microbubble-contained liquid generator 1 by the circulation pump 2, and forwarded under pressure to the pressure tank 3. The water is thus contained in the pressure tank 3 under pressure. The water in the pressure tank 3 is partially returned to the water bath 4 via the discharge pipe 16 and the microbubble generator 20, and partially flows into the circulation pipe 7. The water having flowed into the circulation pipe 7 takes in air from the suction port 9 while it passes through the venturi tube 8. Then, the water containing the air merges the raw water coming from the raw water pipe 5, and it is pumped up by the circulation pump 2. The air in the water is crushed into relatively small bubbles by the circulation pump 2, and dissolution of air into the water is promoted.

In a predetermined length of time after the microbubble-contained liquid system 1 is driven, the water in the pressure tank 3 becomes air-dissolved water containing and mixed with bubbles, and fills the pressure tank 3. After the system 1 stably exhibits this condition, until the water is discharged from the pressure tank 3 into the water bath 4 via the discharge pipe 16, the water passes through the restriction passage 17 of the microbubble generator 20, and the water exiting from the restriction passage 17 is discharged to the water bath 4 via the outer cylinder 201 while hitting against the inner wall of the outer cylinder 201.

The microbubble generator 20 further includes a pressure chamber 210 defined by the bulkhead 202 and the inner cylinder 203, and the restriction passage 17 communicates with this pressure chamber 210. More specifically, the inner cylinder 203 serves as a side wall of the pressure chamber 210, and the pressure chamber 210 has a depth corresponding to the lengthwise size of the inner cylinder 203. The deep portion of the pressure chamber 210 communicates with the restriction passage 17. The microbubble generator 20 further includes a low-pressure chamber 211 defined by a downstream portion of the outer cylinder 201. An auxiliary chamber 212 communicating with the low-pressure chamber 211 is preferably provided between the outer cylinder 201 and the inner cylinders 203.

The air-dissolved water containing and mixed with bubbles, which flows from the pressure tank 3 and reaches the discharge pipe 16, then enters into the pressure chamber 210 via the liquid passage holes 202*a* formed in the bulkhead 202 of the microbubble generator 20. Then, it goes out from the pressure chamber 210 and passes through the clearance between the circumferential flange 203*a* of the inner cylinder 203 and the disk 204, namely, through the restriction passage 17. Further, the air-dissolved water is spurted from the restriction passage 17, and enters into the low-pressure chamber 211 of the outer cylinder 201 while hitting against the inner wall of the outer cylinder 201 and bringing the phenomenon of cavitation.

The air-dissolved water in the pressure tank 3 creates a whirl flow in the recess 206 in the wall surface of the restriction passage 17 when passing through the restriction passage 17. The whirl flow causes generation of microbubbles in the water. Then, just after exiting from the restriction passage 17, the microbubbles strike the inner wall of the outer cylinder 201 and become miniaturized more.

Experimental tests proved that the amount of oxygen dissolved in the water bath 4 changed with time as follows:

| Elapsed time | Amount of dissolved oxygen (ppm) |
|---|---|
| At the start of the system 1 | 4.28 |
| 15 min after starting the system 1 | 33 |
| 1 hour after stopping the system 1 | 31 |
| 2 hours after stopping the system 1 | 30 |
| 3 hours after stopping the system 1 | 29 |
| 4 hours after stopping the system 1 | 28 |
| 5 hours after stopping the system 1 | 26 |
| 6 hours after stopping the system 1 | 22 |
| 24 hours after stopping the system 1 | 17 |

Conditions of the tests were as follows:
(1) Capacity of the water bath 4 300 liters
(2) Circulation pump 2 1.5-kW motor
(3) Flow rate of air through the suction port 9 1.5 liters/min Diameters and numbers (in 1 ml of water) of bubbles contained in the microbubble-contained water generated by the microbubble-contained liquid generating system 1 were proved to be as follows:

| | Diameter of bubbles | | | |
|---|---|---|---|---|
| | 20 μm | 50 | 100 | 0.1 to 0.05 |
| Number of bubbles | 1,250,000 | 100,000 | 14,000 | 17,500,000 |

For improvement of the water quality, it is known that diameters of bubbles are preferably about 5 to 50 μm to attain a buoyancy capable of raising suspended solids to the water surface. Also, as already known, bubbles having diameters larger than 10 μm tend to join together into larger bubbles, each other and tend to there is a tendency that in diameter will easily join each other to result in larger bubbles, and as the diameters get smaller and smaller than 10 μm, bubbles tend repel each other and become difficult to join together.

It will be understood from the result of the tests that the distribution of diameters of the microbubbles generated by the microbubble-contained liquid generating system 1 have peaks at 20 μm and between 0.1 to 0.05 μm. Of course, diameters of microbubbles generated by the system can be changed by adjusting the distance between the circumferential flange 203*a* and the disk 204 and/or by regulating the pressure in the pressure tank 3. However, it should be remarked that the microbubble-diameter distribution has peaks. This means that variety in diameter of bubbles contained in the microbubble-contained water is small.

The microbubble-contained water produced by the tests and containing bubbles with diameters having peaks at peaks at 20 μm and between 0.1 to 0.05 μm has both the function of raising suspended solids up to the water surface and the function of retaining a large quantity of microbubbles in the water. The latter function meets the fact that the high concentration of dissolved oxygen was maintained even after expiration of 24 hours from interruption of operation of the microbubble-contained liquid generating system 1. It will be understood from the result of the tests that, although diameters of bubbles generated by existing microbubble-contained liquid generating apparatuses were several μm, the microbubble-contained liquid generating system 1 according to the embodiment of the invention can generate bubbles having diameters reduced to one tenth or less. Therefore, microbubbles contained in the microbubble-contained water generated by the system 1 according to the embodiment of the invention continue to exist for a long period of time.

FIGS. 1 and 2 show the embodiment of the microbubble-contained liquid generating system 1 of the present invention, which is applied to improvement of water quality. This system 1 introduces water from the water bath 4 containing water to be treated, then generates microbubbles in the water, and returns the water now containing the microbubbles to the water bath 4. As a result, the water in the water bath 4 is changed to contain a large quantity of microbubbles; suspended solids in the water bath 4 are urged by the bubbles up to the water surface; and relatively heavy substances sink deeply to the bottom of the water bath 4. After removal of such suspended solids urged to the water surface by the microbubbles and such sediments staying on the bottom of the water bath 4, the water in the middle layer in the water bath 4 becomes clean water that contains a large quantity of minute bubbles and can activate aerobic microbes.

Figure 6:
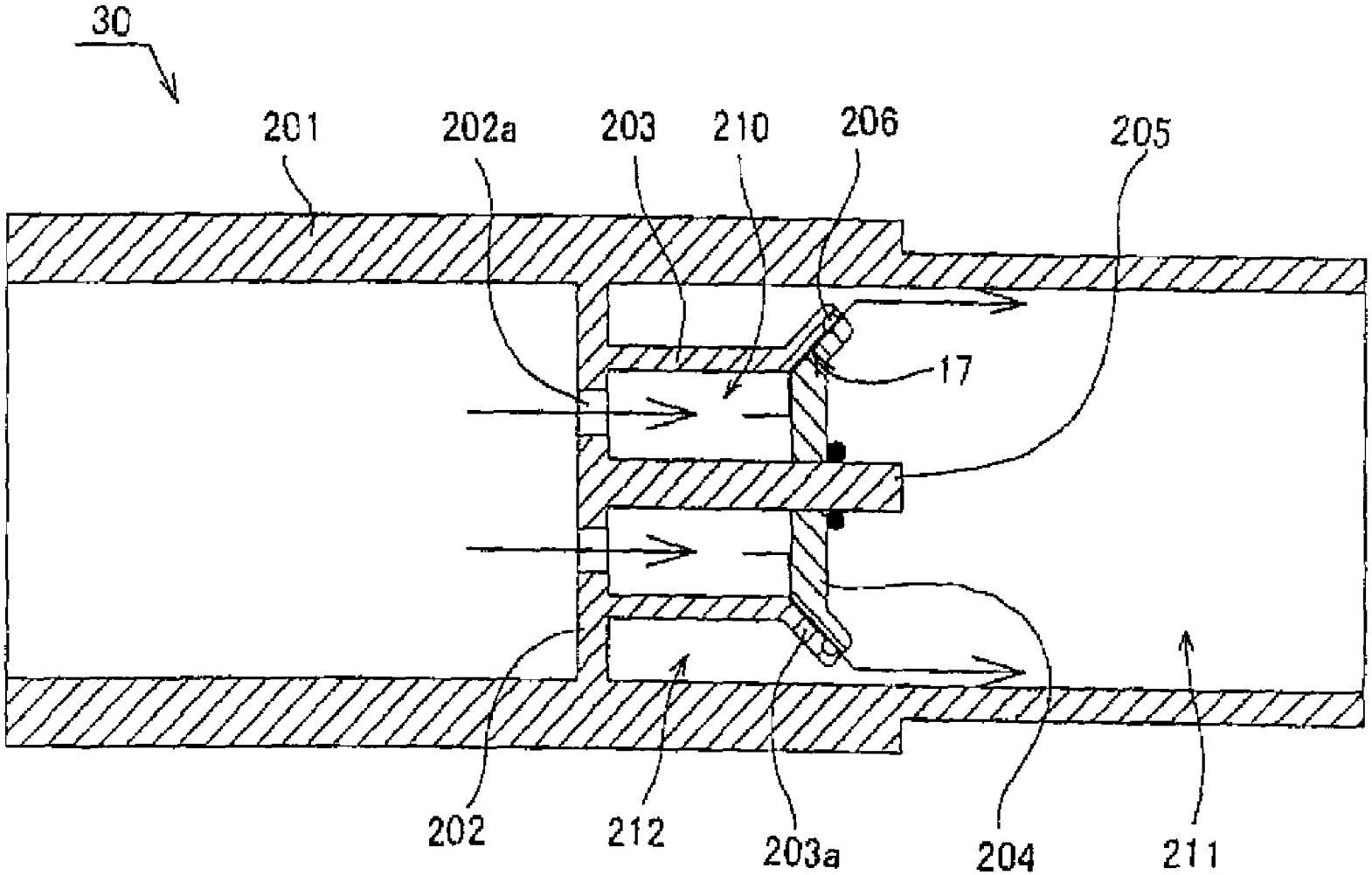
FIG. 6 is a sectional view of a modification of the microbubble generator.

FIG. 6 shows a modification 30 of the microbubble generator 20. The modified microbubble generator 30 is different from the microbubble generator 20 according to the first embodiment in that the circumferential flange 203*a* is slanted.

More specifically, in the modified microbubble generator 30, the circumferential flange 203*a* is slanted in the downstream direction from the downstream end of the inner cylinder 203, and accordingly, the disk 204 is also slanted toward the downstream by bending an outer circumferential portion thereof in the downstream direction.

Figure 7:
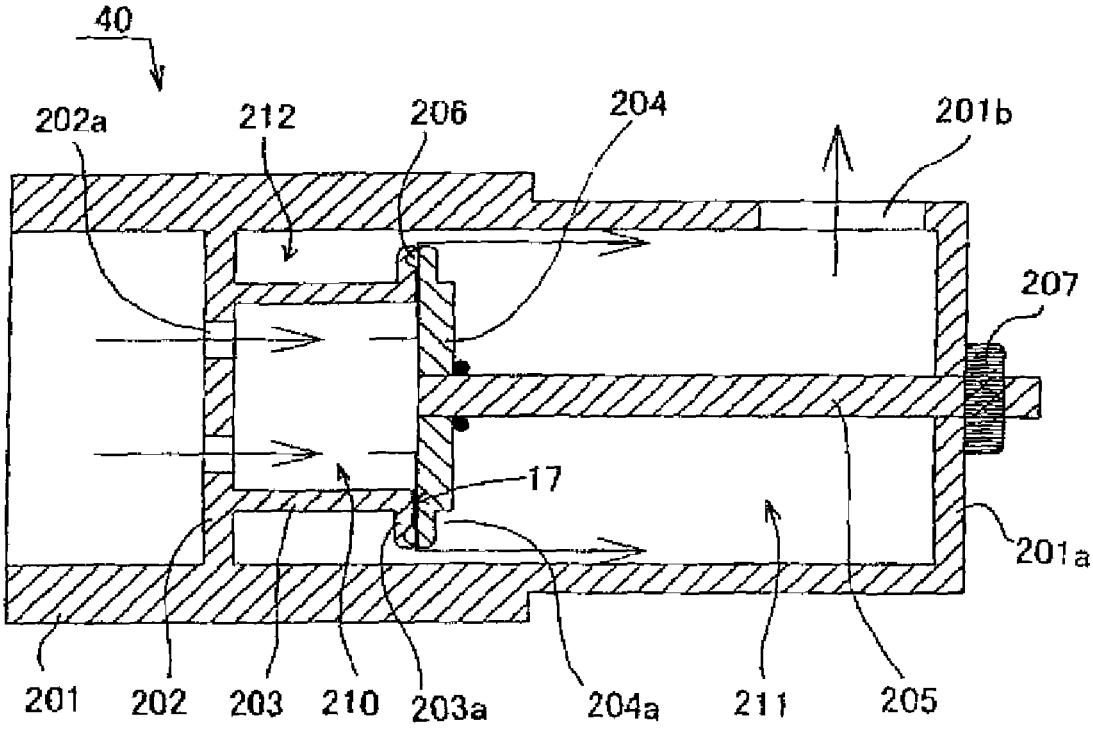
FIG. 7 is a sectional view of another modification of the microbubble generator.

FIG. 7 shows another modification 40 of the microbubble generator 20. In the modified microbubble generator 40, the downstream end of the outer cylinder 201 is closed by a wall 201*a* and a discharge port 201*b* is formed in the downstream-side side wall of the outer cylinder 201. Also, the downstream end of the support pin 205 penetrates the downstream closing wall 201*a* of the outer cylinder 201 and extends externally, whereas the upstream end thereof is united to the disk 204. In this modified microbubble generator 40, the distance between the circumferential flange 203*a* and the disk 204 can be adjusted by loosening a fastener 207 and moving the support pin 205.

Figure 8:
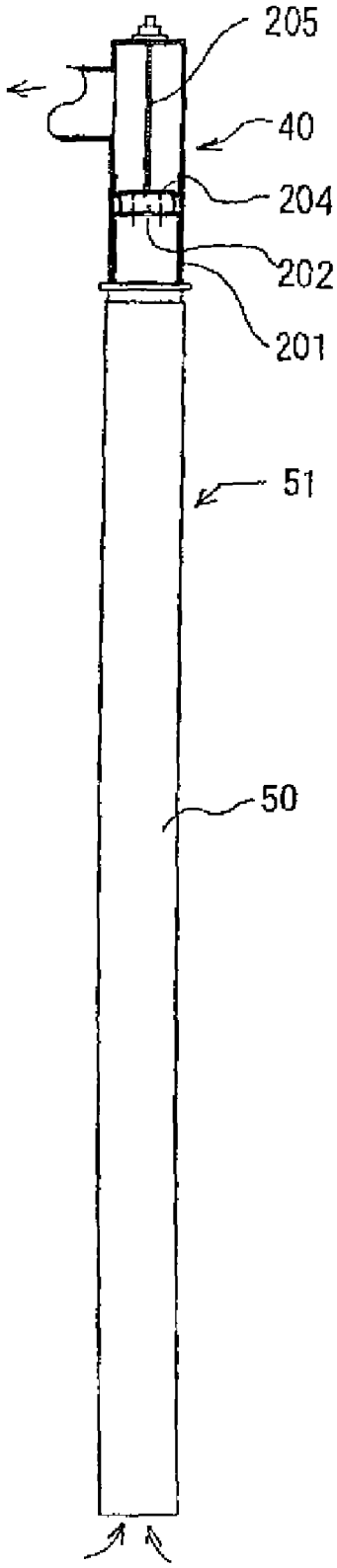
FIG. 8 is a partial cross-sectional view of the microbubble-contained liquid generating system for generating microbubbles under water.
Figure 9:
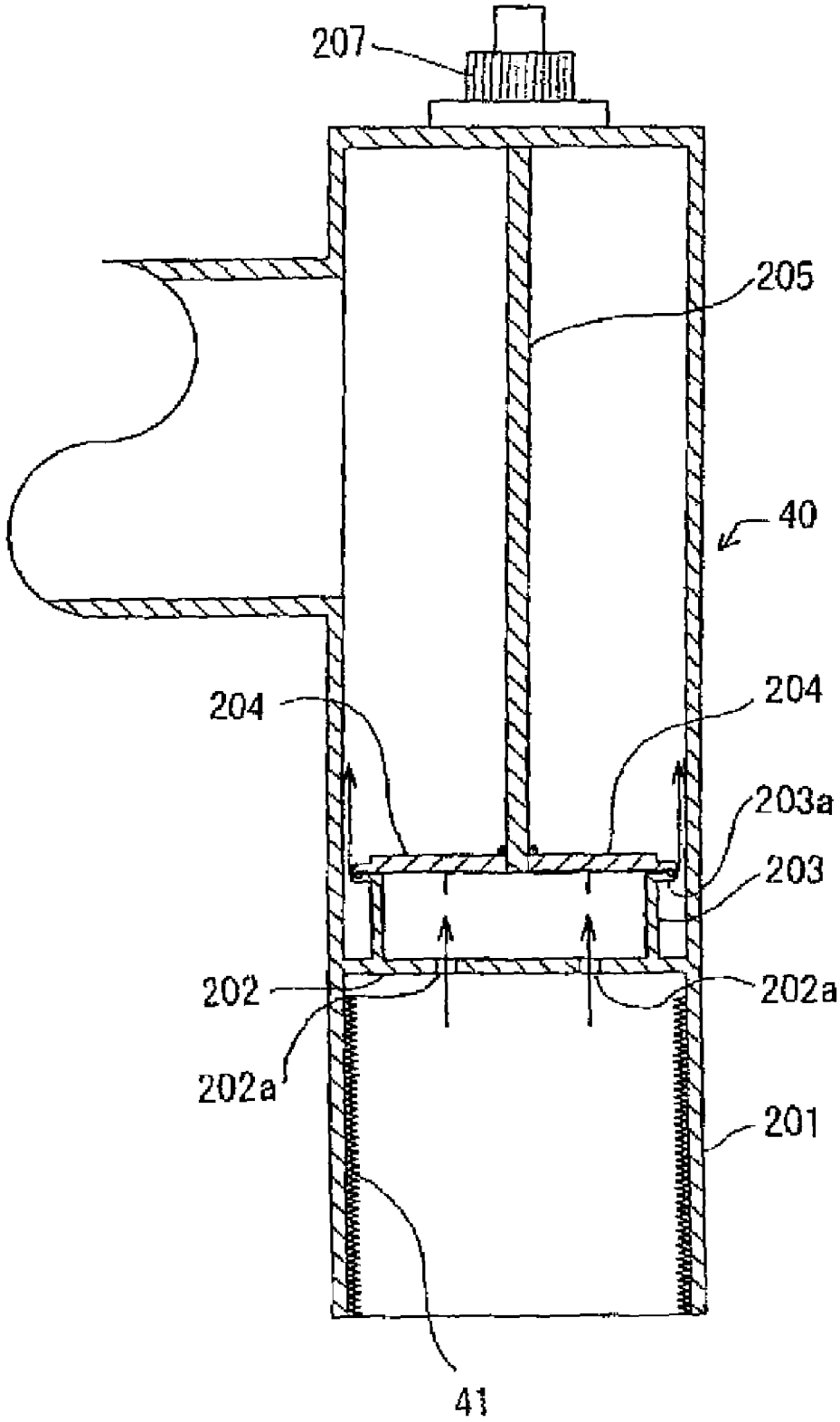
FIG. 9 is a cross-sectional view of a microbubble generator to be assembled in a microbubble-contained liquid generating system equipped with an underwater pump.

The microbubble-contained liquid generating system 1 may be modified to use an air nozzle, for example, in place of the venturi tube 8. That is, with the nozzle end being disposed in the circulation pipe 7 (as shown in FIGS. 1 and 2), compressed air may be expelled from the nozzle to supply it to water flowing in the circulation pipe 7. The microbubble-contained liquid generating system 1 already explained with reference to FIGS. 1 and 2 is configured for installation on the ground. However, the microbubble generator 40 may be joined with an underwater pump to generate microbubbles under water. FIGS. 8 and 9 show an exemplary assembly of the underwater pump and the microbubble generator 40. Of course, the microbubble generator 20 or 30 explained above with reference to FIGS. 4 and 7 may be used in such an assembly as well.

With reference to FIGS. 8 and 9, the outer cylinder 201 of the microbubble generator 40 has a female screw 41 formed in the inner wall of an upstream portion thereof (FIG. 9). On the other hand, an underwater pump 50 shown in FIG. 8 has a male screw (not appearing in the drawings) formed at an outlet end portion thereof. Thus, the microbubble generator 40 is screwed on the outlet end portion of the underwater pump 50 to form an underwater microbubble-contained liquid generating system 51.

Heretofore, some preferred embodiments of the present invention have been explained in conjunction with the drawings. The present invention, however, contemplates the following changes and modifications.

As the first modification, the restriction passage 17 included in the microbubble generator 20 or any one of its modifications may be a thin tube, and the inner wall of the outer cylinder 201 may be replaced by a stationary, fixed, collision surface for collision of microbubble-contained liquid spurting from the restriction passage 17.

As the second modification, the pressure chamber 210 provided in the microbubble generator 20 or any one of its modifications may be omitted by instead increasing the pressure in the pressure tank 3. In other words, if the pressure chamber 210 is provided in the microbubble generator 20, for example, then the pressure in the pressure tank 3 can be reduced to a relatively low level. As a result, a relatively small pump may be used as the circulation pump 2, and the cost of the microbubble-contained liquid generating system 1 can be reduced accordingly.

As the third modification, if the pressure chamber 210 is provided in the microbubble generator 20 or any one of its modifications to supply a gas-dissolved liquid under a relatively high pressure to the restriction passage 17, then the bubbles contained in the microbubble-contained liquid from the restriction passage 17 can be increased in number or further reduced in size. Therefore, in the case where the bubbles may have diameters equal to or slightly smaller than those of bubbles generated by existing techniques, the recess 206 may be omitted from the restriction passage 17.

The microbubble-contained liquid generating system according to the present invention can generate a liquid containing microbubbles of any of various gases such as air, carbon dioxide ($CO_2$), nitrogen gas ($N_2$), ozone ($O_3$), chloride gas ($Cl_2$), inactive gas, etc., and the microbubble-contained liquids containing such microbubbles can be used for various purposes. For example, such liquids can be used in home baths and cosmetic baths, as cosmetic liquids, in hot springs and swimming pools, for water purification of rivers and lakes, water treatment in water supply and sewerage systems, for washing and sterilization of farm crops such as vegetables, as oxygen-rich drinking water for livestock, for washing and sterilization of eggs, and filtration in beer manufacturing, as fish-culturing water, medical-use water against skin infection, for treatment of industrial waste liquid, for washing semiconductor chips and precision machines, washing of pipes, treatment of crude-carrier ballast, oil separation, floating and removal of dissolved substances, etc.

What is claimed is:

1. A microbubble-contained liquid generating system, comprising:

a pressure tank receiving a liquid supplied from a liquid source;

a circulation pipe equipped with a circulation pump which draws the liquid from the pressure tank and returns the drawn liquid to the pressure tank;

a gas supply means located upstream of the circulation pump to supply a gas to the liquid flowing in the circulation pipe;

a discharge pipe connected to the pressure tank to externally discharge a microbubble-contained liquid from the pressure tank; and a microbubble generator provided in the discharge pipe and having a restriction passage which has a recess formed in a wall surface thereof and permits a gas-dissolved liquid supplied from the pressure tank to pass through.

2. A microbubble-contained liquid generating system, comprising:

a pressure tank receiving a liquid supplied from a liquid source;

a circulation pipe equipped with a circulation pump which draws the liquid from the pressure tank and returns the drawn liquid to the pressure tank;

a gas supply means located upstream of the circulation pump to supply a gas to the liquid flowing in the circulation pipe;

a discharge pipe connected to the pressure tank;

a pressure chamber provided in the discharge pipe and having an inner wall isolated from a side wall of the discharge pipe; and a restriction passage communicating with the pressure chamber, said restriction passage having a recess formed in a wall surface thereof.

3. The microbubble-contained liquid generating system according to claim 2 wherein the discharge pipe has a bouncing surface such that the microbubble-contained liquid exiting from the restriction passage hits against the bouncing surface.

4. A microbubble generator, comprising:

a main pipe through which a gas-dissolved liquid supplied under pressure flows;

an intermediate wall partitioning the main pipe and having openings formed in a central portion thereof;

a small-diameter pipe continuous from a downstream wall surface of the intermediate wall to face to the openings;

a flange provided at the downstream end of the small-diameter pipe to extend radially outward; and a disk disposed to close the downstream end of the small-diameter pipe, wherein the disk and flange in combination define a restriction passage, and a recess is formed in one or both of opposed surfaces of the disk and the flange.

5. The microbubble generator according to claim 4 wherein the flange extends across the axial line of the small-diameter pipe.

6. The microbubble generator according to claim 4 wherein the flange extends to slant in the downstream direction from the downstream end of the small-diameter pipe.

7. The microbubble generator according to claim 4 wherein at least one of the flange and the disk has a groove formed therein to serve as the recess.

* * * * *